US005352973A

United States Patent [19]

Audy

[11] Patent Number: 5,352,973

[45] Date of Patent: Oct. 4, 1994

[54] TEMPERATURE COMPENSATION BANDGAP VOLTAGE REFERENCE AND METHOD

[75] Inventor: Jonathan M. Audy, Campbell, Calif.

[73] Assignee: Analog Devices, Inc., Norwood, Mass.

[21] Appl. No.: 4,097

[22] Filed: Jan. 13, 1993

[51] Int. Cl.[5] ..... G05F 3/16

[52] U.S. Cl. ..... 323/313; 307/296.6; 330/256; 330/289; 323/907

[58] Field of Search ..... 323/313, 315, 907, 314, 323/316; 307/296.6, 310; 330/256, 257, 288, 289, 296, 297

[56] References Cited

U.S. PATENT DOCUMENTS

| | | | |
|---|---|---|---|
| 4,250,445 | 2/1981 | Brokaw | 323/313 |
| 4,348,633 | 9/1982 | Davis | 323/314 |
| 4,714,872 | 12/1987 | Traa | 323/314 |
| 4,808,908 | 2/1989 | Lewis et al. | 323/313 |
| 4,939,442 | 7/1990 | Carvajal et al. | 323/281 |
| 5,053,640 | 10/1991 | Yum | 307/296.6 |
| 5,087,831 | 2/1992 | Ten Eyck | 307/296.6 |
| 5,160,882 | 11/1992 | Ten Eyck | 323/314 |
| 5,291,122 | 3/1994 | Audy | 323/313 |

OTHER PUBLICATIONS

Grebene, *Bipolar and MOS Analog Integrated Circuit Design*, John Wiley & Sons, 1984, pp. 206–209.

Fink et al., Ed., *Electronics Engineers' Handbook*, 3d ed., McGraw-Hill Book Co., 1989, pp. 8.48–8.50.

*Primary Examiner*—Steven L. Stephan
*Assistant Examiner*—Adolf Berhane
*Attorney, Agent, or Firm*—Koppel & Jacobs

[57] ABSTRACT

An output curvature correction is provided for a bandgap reference circuit that exhibits a temperature dependent output error in the form of $k_1T - k_2 T\ln(k_3T)$ in the absence of the correction. A substantially constant collector current is driven through a correction transistor and used in connection with a proportional to absolute temperature (PTAT) transistor collector current in the uncorrected circuit. The difference between the base-emitter voltages for the two transistors has the form $-k_1'T + k_2'\ln(k_3'T)$. This voltage differential is scaled by an appropriate selection of resistor ratios and combined with the uncorrected circuit output to provide a corrected output that is substantially insensitive to temperature variations.

11 Claims, 2 Drawing Sheets

TEMPERATURE COMPENSATION BANDGAP VOLTAGE REFERENCE AND METHOD

RELATED APPLICATION

This application is related to U.S. Ser. No. 07/897,312, filed Jun. 11, 1992 by the same applicant.

BACKGROUND OF THE INVENTION

1. Field of the Invention

This invention relates to bandgap voltage reference circuits, and more particularly to such circuits in which an attempt is made to correct for a T-Tln(T) deviation from a constant output voltage.

2. Description of the Related Art

Bandgap reference circuits have been developed to provide a stable voltage supply that is insensitive to temperature variations over a wide temperature range. These circuits operate on the principle of compensating the negative temperature drift of a bipolar transistor's base-emitter voltage ($V_{be}$) with the positive temperature coefficient of the thermal voltage $V_T$, which is equal to kT/q, where k is Boltzmann's constant, T is the absolute temperature in degrees Kelvin and q is the electronic charge. A known negative temperature drift associated with the $V_{be}$ is first generated. A positive temperature drift due to the thermal voltage is then produced, and is scaled and subtracted from the negative temperature drift to obtain a nominally zero temperature dependence. Numerous variations in the bandgap reference circuitry have been designed, and are discussed for example in Grebene, *Bipolar and MOS Analog Integrated Circuit Design*, John Wiley & Sons, 1984, pages 206–209, and in Fink, et al. Ed., *Electronics Engineers' Handbook*, 3d ed., McGraw-Hill Book Co., 1989, pages 8.48–8.50.

Although the output of a bandgap voltage cell is ideally independent of temperature, the outputs of prior cells have been found to include a term that varies with T -Tln (T), where in is the natural logarithm function. Such an output deviation is shown in FIG. 1, in which the bandgap voltage output ($V_{bg}$) increases from a value of about 1.2408 volts at −50° C. to about 1.244 volts at about 45° C., and then returns back to about 1.2408 volts at 150° C. This output deviation is not symmetrical; its peak is skewed about 5° C. below the midpoint of the temperature range.

It is difficult to precisely compensate for the temperature deviation electronically, so simpler approximations have been used. One such circuit is shown in FIG. 2, and is described in U.S. Pat. No. 4,808,908 to Lewis et al., assigned to Analog Devices, Inc., the assignee of the present invention. The circuit includes bipolar npn transistors Q1 and Q2, with the emitter area of Q1 scaled larger than that of Q2 by a factor A. The emitters of Q1 and Q2 are connected together through a resistor Ra that has a relatively low temperature coefficient of resistance (TCR). A second relatively low TCR resistor Rb is connected in series with a relatively high TCR resistor Rc between the Ra/Q2 emitter junction and a negative (or ground) return voltage bus V−. Q1 and Q2 are provided with collector currents having a constant ratio, such as by connecting their collectors respectively to the inverting and non-inverting inputs of an operational amplifier. Ra and Rb are preferably implemented as thin film resistors, with TCRs on the order of 30 ppm (parts per million)/° C. Rc is preferably a diffused resistor having a TCR of typically 1,500–2,000 ppm/° C.

The base output voltage $V_{bg}$ is equal to the sum of $V_{be}$ for Q2 and the voltage drops across Rb and Rc. In the absence of Rc, the voltage across Rb can be determined by considering the voltage across Ra. This is equal to the difference in $V_{be}$ for Q1 and Q2; since the emitter of Q1 is larger than the emitter of Q2 but both transistors may carry equal currents, the emitter current density of Q1 will be less than for Q2, and Q1 will accordingly exhibit a smaller $V_{be}$. The $V_{be}$ differential between Q1 and Q2 will have the form $V_T\ln(Id2/Id1)=V_T\ln(A)$, where I1 and I2 are the absolute emitter currents, and Id1 and Id2 are the emitter current densities of Q1 and Q2, respectively. Since I1 is preferably equal to I2, the current through Rb will be twice the current through Ra, so that the voltage across Rb will have the form $(2Ra/Rb)V_T\ln(A)$. Still ignoring Rc, the described circuit will exhibit the output temperature deviation mentioned above.

The addition of high TCR resistor Rc approximates an output voltage compensation by producing a square law ($T^2$) term that is added to $V_{bg}$. Since the tail current through Rb is proportional to temperature anyway, adding a significant temperature coefficient by means of the high TCR tail resistor Rc yields a voltage across this resistance that is proportional to $T^2$. Combining this square law voltage with the voltage across Rb and $V_{be}$ for Q2 approximately cancels the effect of the temperature deviation.

Rc is preferably a diffused resistor, which is not subject to trimming. However, the resistance values of thin film resistors Ra and Rb can be conveniently adjusted by laser trimming to minimize the first and second derivatives of the bandgap cell output as a function of temperature.

Unfortunately, the square law voltage compensation produced by the FIG. 2 circuit is symmetrical, as opposed to the skewed parabolic shape of the temperature deviation that actually characterizes the bandgap cell. Thus, the voltage correction that can be achieved with the FIG. 2 circuit is limited, and a significant residual temperature coefficient is left in both the upper and lower portions of the temperature range.

SUMMARY OF THE INVENTION

The present invention seeks to provide a precise compensation for the T - Tln(T) deviation of a bandgap reference cell, without unduly complicating the circuitry or adding process steps. It does this with a compensation mechanism that relies only upon the ratio of resistor values and transistor areas, rather than absolute resistance values and transistor areas, and is thus insensitive to process variations.

These goals are achieved by generating a constant collector current for a bipolar correction transistor, taking the difference between the base-emitter voltage of the correction transistor and the base-emitter voltage for one of the bandgap cell transistors (whose base provides an output voltage), and adding this voltage differential to the uncorrected base output voltage. The correction voltage, which represents the base-emitter voltage differential between bipolar transistors which respectively have constant and proportional to absolute temperature (PTAT) collector currents, has the form $-k_1t + k_2\ln(k_3T)$, where $K_1$, $k_2$ and $k_3$are constants. With an appropriate scaling of resistor ratios in the basic bandgap cell and in the correction circuit, the correction voltage can be made to substantially cancel the temperature-induced curvature in the basic cell's output.

In a preferred embodiment, the correction circuit includes a correction transistor whose collector, base and emitter are respectively connected to the inverting, non-inverting and output of an operational amplifier (op amp). Its emitter is connected through a first correction resistor to the tail resistor of the uncorrected bandgap reference circuit, while its collector is connected through a second correction resistor to a voltage supply. The op amp produces a substantially constant collector current drive for the correction transistor, and at the same time provides an essentially constant voltage source to drive a correction current through the differential correction resistor. The op amp design can be very simple, involving only three transistors and a single resistor.

These and other features and advantages of the invention will be apparent to those skilled in the art from the following detailed description, taken together with the accompanying drawings.

DETAILED DESCRIPTION OF THE INVENTION

Figure 3:
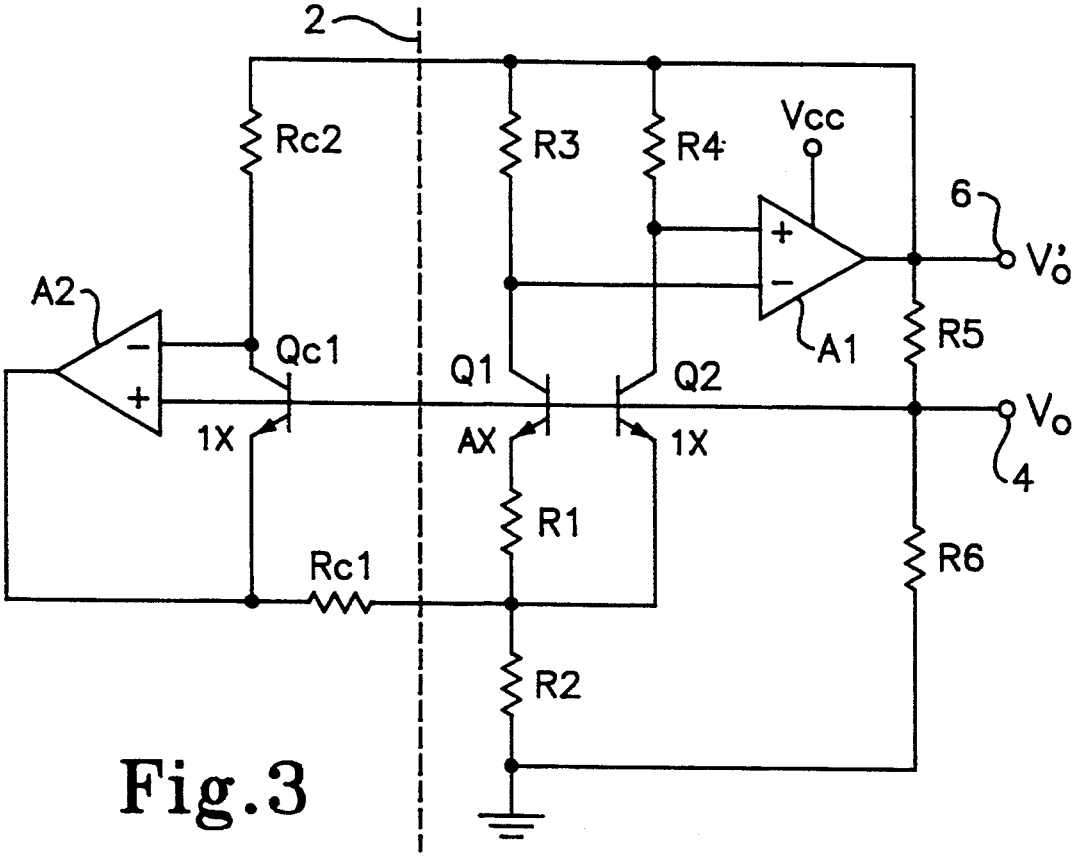
FIG. 3 is a schematic diagram of a preferred circuit for implementing the invention.

A preferred embodiment of the invention is shown in FIG. 3. It includes a basic bandgap reference cell, shown to the right of dashed line 2, that is subject to the T - Tln(T) temperature curvature deviation described above. The two cell transistors are designated Q1 and Q2, with the emitter of Q1 scaled larger than the emitter of Q2 by a factor A. A first resistor R1 is connected across the emitters of Q1 and Q2, while a tail resistor R2 is connected from R1 to a low return voltage reference, preferably ground. All of the resistors in the circuit preferably have equal temperature coefficients. A cell output $V_o$ is provided at terminal 4, which is connected to the bases of Q1 and Q2. With proper resistor trimming, the cell output voltage $V_o$ at terminal 4 equals the bandgap energy Eg of the material from which the circuit is formed. Eg varies with the particular process used to fabricate the circuit; for silicon it is typically in the approximate range of 1.17–1.19.

An op amp A1 has its non-inverting and inverting inputs connected to the collectors of Q2 and Q1, respectively, thereby establishing equal collector voltages for the two transistors. The collectors of Q1 and Q2 are also connected to the op amp output through respective resistors R3 and R4. These resistors are generally equal to each other, thus establishing equal collector currents for Q1 and Q2; a current mirror could also be used for this purpose. A1 is supplied from the circuit's positive voltage reference Vcc. It can be used to provide the ultimate output reference voltage by setting its output at a fixed multiple of the $V_o$ bandgap voltage at terminal 4. This is preferably accomplished with a simple resistive voltage divider circuit that consists of a resistor R5 connected between an output terminal 6 for the op amp output $V_o'$, and another resistor R6 connected between terminal 4 and ground. The known equation for the convention bandgap reference circuit described thus far is:

$$V_o = E_g - (E_g - V_{beQ2})\frac{T}{T_{ref}} - (\sigma - 1)\frac{K}{q}T\ln\left(\frac{T}{T_{ref}}\right) + 2\frac{R2}{R1}\frac{K}{q}T\ln(A) \quad (1)$$

where $V_{beQ1}$ is the base-emitter voltage of Q1 at an arbitrary reference temperature $T_{ref}$, which may be room temperature, T is the operating temperature, $\sigma$ is the saturation current temperature exponent (referred to as XTI in the SPICE TM circuit simulation program developed by the University of California at Berkeley, and equal to 3.0 for diffused silicon junctions), K is Boltzmann's constant, q is the electron charge, in is the natural logarithm function and A is the ratio of the emitter area of Q1 to Q2.

It can be seen that the temperature dependent portion of the above equation has the form $k_1t - k_2T\ln(k_3T)$ where $$k_1 = \left[-\frac{E_g - V_{beQ2}}{T_{ref}} + 2\frac{R2}{R1}\frac{K}{q}\ln(A)\right], \quad (2)$$

$$k_2 = (\sigma - 1)\frac{K}{q}, \quad (3)$$

and $$k_3 = \frac{1}{T_{ref}}. \quad (4)$$

In accordance with the invention, a correction circuit is added to the basic bandgap reference cell described thus far that accurately compensates for this temperature dependency in the cell output.

A preferred form of the compensation circuit is shown to the left of dashed line 2. It consists of a correction bipolar transistor Qc1 having an emitter that is conveniently scaled equal to Q2, although the circuit could also be adjusted to accommodate non-equal emitter scalings; an op amp A2 having its inverting input connected to the collector of Qc1, its non-inverting input connected to the bases of Qc1, Q1 and Q2, and its output connected to the emitter of Qc1; a first correction resistor Rc1 that is connected between the A2 output/Qc1 emitter and the junction between R1 and the tail resistor R2 in the uncorrected cell; and a second correction resistor Rc2 that is connected between the collector of Qc1 and $V_o'$. The described feedback circuit of op amp A2 has a high impedance output and drives the emitter of Qc1 until its collector current is a substantially constant, temperature insensitive value. The op amp A2 forces the collector-base voltage of Qc1 to zero, and thus forces the voltage across Rc2 to $V_o'-V_o$.

It is known that if one bipolar transistor has a PTAT collector current while another bipolar transistor has a constant collector current that is temperature insensitive, the difference between the base-emitter voltages for the two transistors will have the following form:

$$\Delta V_{be} = \frac{K}{q} T\ln\left(\frac{I_{PTAT}}{I_{constant}}\right), \tag{5}$$

which can be rewritten as:

$$\Delta V_{be} = \frac{K}{q} T\ln(I_{PTAT}) - \frac{K}{q} T\ln(I_{constant}). \tag{6}$$

This equation can in turn be rewritten as:

$$\Delta V_{be} = -k1'T + k_2'T\ln(k_3'T), \tag{7}$$

where $k_1'$, $k_2'$ and $k_3'$ are constants. The invention makes use of this relationship by generating a differential base-emitter voltage such that $k_1'$, $k_2'$ and $k_3'$ are respectively equal to $k_1$, $k_2$ and $k_3$ in the uncorrected cell's output voltage, and combining the $\Delta V_{be}$ term with the uncorrected output to substantially cancel the temperature deviation and leave a temperature-insensitive output.

Since the collector currents of Q1 and Q2 are already PTAT currents, the invention uses the constant collector current of Qc1 to establish the necessary $\Delta V_{be}$ term. Its base-emitter voltage is used together with the base-emitter voltage of Q2, rather than Q1, to avoid upsetting the PTAT current generation.

The correction resistor Rc1 is connected across the emitters of Qc1 and Q2, while the bases of these two transistors are tied together. A voltage is thus established across Rc1 that represents the difference between the base-emitter voltages of two transistors that have respective constant and PTAT collector currents, and the current through Rc1 will therefore be:

$$I_{Rc1} = \frac{K}{qRc1} T\ln\left(\frac{I_{PTAT}}{I_{constant}}\right). \tag{8}$$

In addition to forcing a constant collector current for Qc1, the output of op amp A2 essentially functions as a constant voltage source, providing whatever current is necessary for $I_{Rc1}$ without losing any precision in the voltage which keeps the collector current of Qc1 constant.

The current through Rc1 flows through the bandgap cell's tail resistor R2, where it produces a voltage:

$$V_{R2} = \frac{K}{q} \frac{R2}{Rc1} T\ln\left(\frac{I_{PTAT}}{I_{constant}}\right). \tag{9}$$

The PTAT Q2 collector current has the standard form $$\frac{K}{q} \frac{T\ln(A)}{R1},$$

while the constant collector current of Qc1 has the form $$\frac{(V_o' - V_o)}{Rc2}.$$

. Substituting these terms into equation (9) for $V_{R2}$ yields $$V_{R2} = \frac{K}{q} \frac{R2}{Rc1} T\ln\left[\frac{\frac{K}{q}\frac{T\ln(A)}{R1}}{\frac{V_o' - V_o}{Rc2}}\right], \tag{10}$$

which can be rearranged as $$V_{R2} = \frac{K}{q} \frac{R2}{Rc1} T\ln\left[\frac{\frac{K}{q} T\ln(A)}{\frac{R1}{Rc2}(V_o' - V_o)}\right]. \tag{11}$$

Comparing these equations for $V_{R2}$ with equations (1) - (4) above, and recalling that $\ln(x/y) = \ln x - \ln y$, a cancellation of the $k_1T - K_2T\ln(k_3T)$ error term in the cell outputcan be obtained by setting $$k_1 = -\frac{(E_g - V_{beQ2})}{T_{ref}} + 2\frac{R2}{R1}\frac{K}{q}\ln(A) = \frac{K}{q}\frac{R2}{Rc1}\ln\left[\frac{R1}{Rc2}(V_o' - V_o)\right], \tag{12}$$

$$k_2 = \frac{(\sigma - 1)K}{q} = \frac{K}{q}\frac{R2}{Rc1}, \tag{13}$$

and $$k_3 = \frac{1}{T_{ref}} = \frac{K}{q}\ln(A). \tag{14}$$

Since all of the other terms are known, the resistor ratios R2/Rc1 and R1/Rc2 can be selected to achieve an accurate cancellation of the temperature variation that would otherwise occur. Although the collector current of Qc1 may not be absolutely constant, the base-emitter voltage of Qc1 varies with the natural logarithm of its collector current, rather than directly with the collector current. Any residual temperature-induced variation in the Qc1 collector current is therefor greatly attenuated in establishing its base-emitter voltage; this attenuated error is carried over to attenuate any resultant error in the correction current through the tail resistor R2.

In practice, the selection of particular device values for a given circuit can be done quite simply. A value of R2 is first selected, and Rc1 is calculated from the equation $$Rc1 = \frac{R2}{(\sigma - 1)}$$

(derived from equation 13). Rc2 is selected to set up a desired constant current, for example 3 microamps. R1 can then be calculated, but since some resistor trimming will normally be required anyway due to manufacturing tolerances, R1 is conveniently selected as the trim resistor. It is trimmed to set $V_o$ equal to Eg. In a particular simulation for silicon, in which Eg was 1.17 and $\sigma$ was 3.0003, the following resistor values were used:

| | | | |
|---|---|---|---|
| R1 | 22.779 kohms | Rc1 | 69.133 kohms |
| R2 | 138.29 kohms | Rc2 | 1.2767 Mohms |

Figure 1:
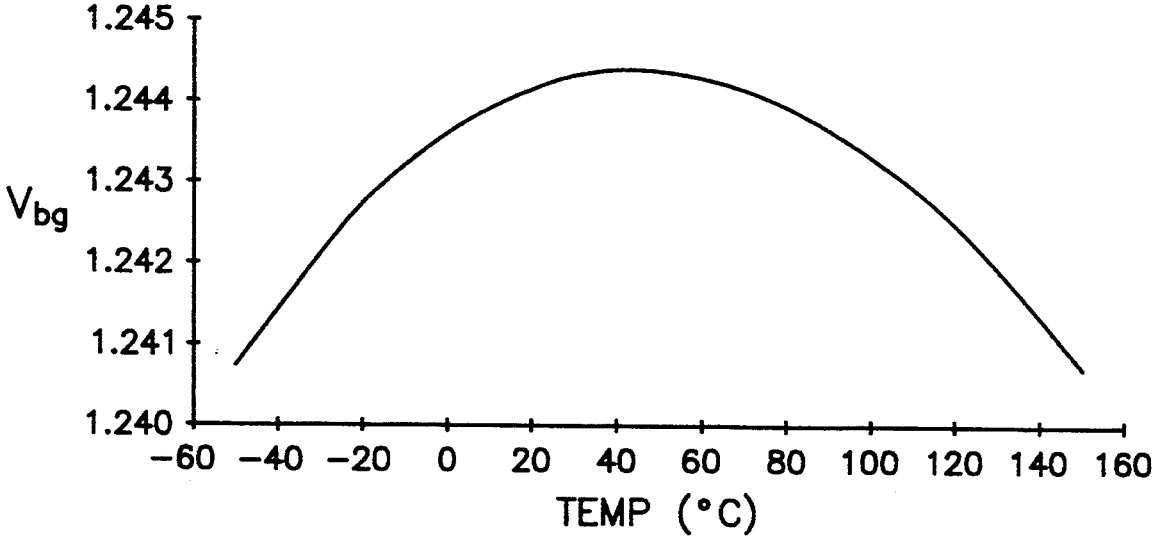
Fig.1 (Prior Art)
FIG. 1 is a graph of a typical T - Tln(T) temperature deviation, described above, for a known bandgap voltage reference circuit.
Figure 2:
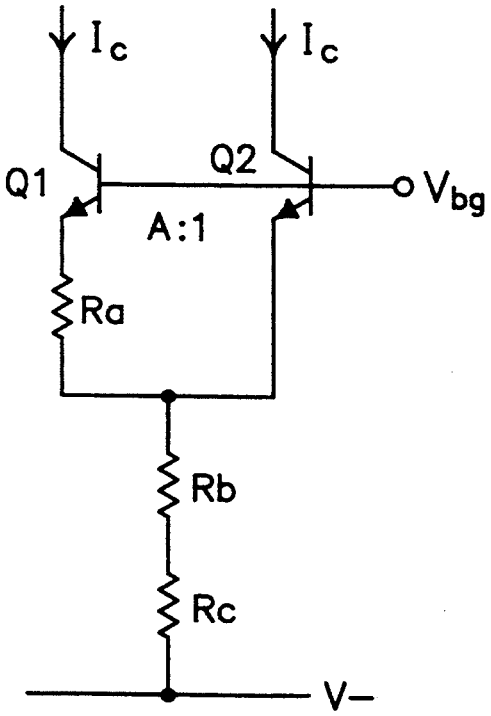
Fig.2 (Prior Art)
FIG. 2 is a schematic diagram of a known bandgap voltage reference circuit, described above, that partially compensates for the output deviation shown in FIG. 1.
Figure 4:
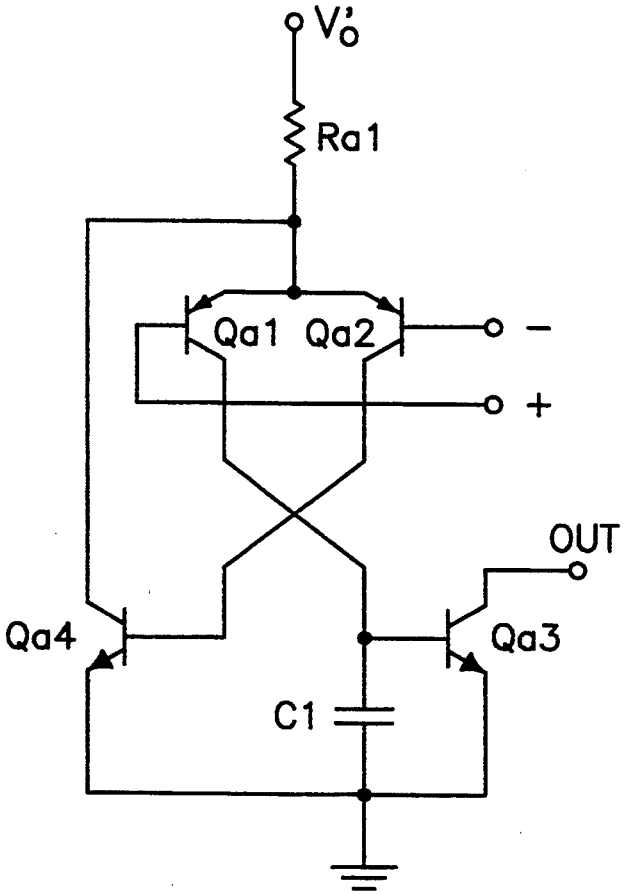
FIG. 4 is a schematic diagram showing the details of a preferred op amp design used in the correction circuit.

One of the advantages of the described circuit is that the correction amplifier A2 can be implemented with a very simple circuit design, requiring only three transistors and one resistor. The preferred amplifier design is shown in FIG. 4. A pair of differentially connected bipolar amplifier transistors Qa1 and Qa2 have their emitters connected together through an amplifier resistor Ra1 to receive the output voltage $V_o'$. Qa1 and Qa2 are pnp transistors, as opposed to the npn devices used for the remainder of the voltage reference circuit. Their bases are connected to provide the non-inverting and inverting amplifier inputs, respectively. The collector of Qa1 biases the base of an amplifier output transistor Qa3 through a stabilizing capacitor C1; the collector of Qa3 provides the op amp output that is connected to Rc1 and the emitter of Qc1, while the Qa3 emitter is grounded.

The collector of Qa2 is preferably connected to bias the base of another transistor Qa4, which has its collector connected to a current supply node such as the emitters of Qa1 and Qa2, and its emitter grounded. Qa4 makes Qa1 and Qa2 operate at essentially the same current; it could be eliminated, but it improves the circuit accuracy.

To avoid a base-emitter voltage differential between Qa1 and Qa2, which would result in a voltage offset at the output of A2, the currents through Qa1 and Qa2 are held equal. This is accomplished by making the current through Ra1 equal the current through Rc2. To this end, the resistance value of Ra1 is set equal to $$Rc2\frac{V_{Ra1}}{V_{Rc2}},$$

which in turn is equal to $$Rc2\frac{(V_o' - V_o - V_{be})}{V_o' - V_o};$$

the base-emitter voltage of Qa2 is approximately 0.6 volts. Qa4 completes the balancing of the current through Qa1 and Qa2.

Figure 5:
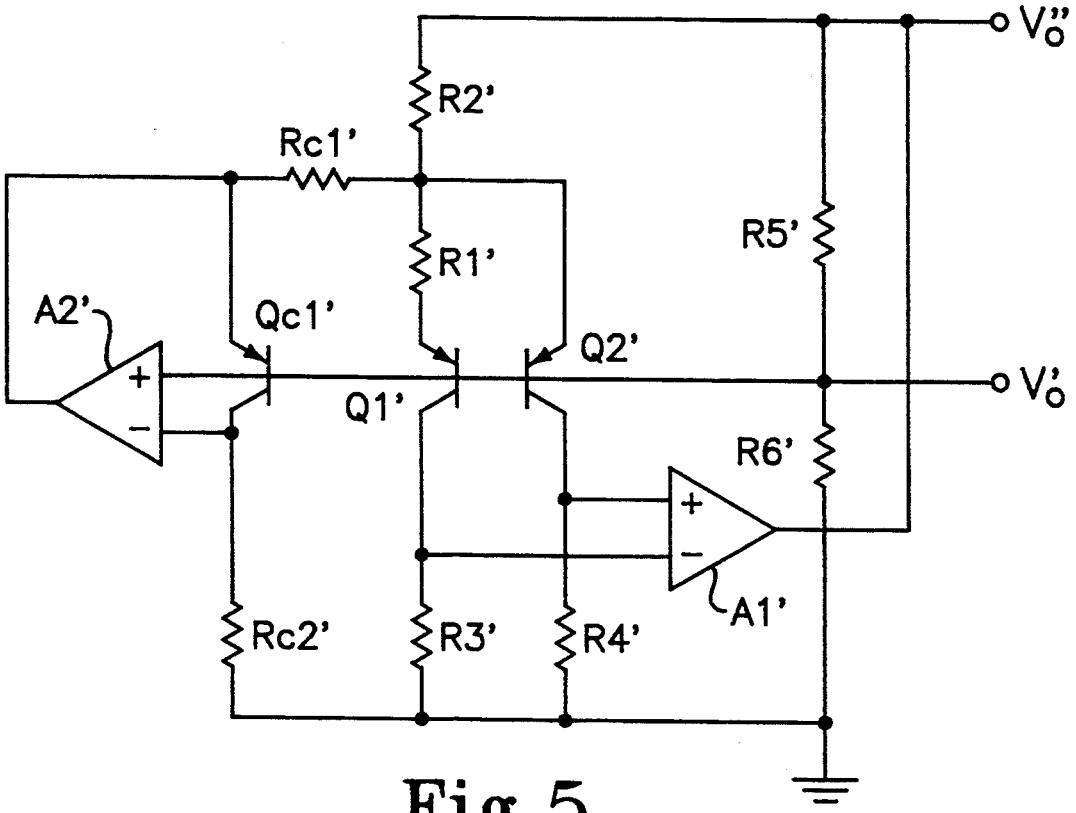
FIG. 5 is a schematic diagram of another embodiment of the invention in which the transistor conductivities are reversed from those shown in FIG. 3.

The invention is applicable to numerous variations of the basic bandgap reference cell described thus far. For example, while it has been shown in connection with a positive bandgap cell that employs npn transistors to establish a positive output voltage, it could be used to establish a negative output by grounding terminal 6 and taking the output from the R2/R6 node that is shown grounded in FIG. 3. The invention is also applicable to a cell with pnp transistors that establishes either a positive or a negative voltage reference. Such a circuit is shown in FIG. 5, in which corresponding elements are identified by the same reference numerals as in FIG. 3, with the addition of a prime. The invention can also be used with other bandgap reference circuits, such as those described in the Grebene and Fink et al. references mentioned above. Accordingly, it is intended that the invention be limited only in terms of the appended claims.

I claim:

1. A bandgap voltage reference circuit with output temperature curvature correction, comprising:

an uncorrected bandgap voltage reference cell that includes a bipolar cell transistor with a collector current that is proportional to absolute temperature (PTAT), and that generates an uncorrected output base voltage over a predetermined temperature range with a temperature curvature component in the form $k_1T - k_2T\ln(k_3T)$, where $k_1$, $k_2$ and $k_3$ are constants and T is absolute temperature, a bipolar correction transistor, a current supply circuit for supplying a substantially constant collector current to said correction transistor, and means for generating a correction voltage that varies continuously with temperature over said temperature range, is proportional to the difference between the base-emitter voltages of said cell and correction transistors and has the form $-k_1T + k_2T\ln(k_3T)$, and for combining said correction voltage with said uncorrected output voltage to substantially cancel the output voltage's temperature curvature component over said temperature range.

2. The circuit of claim 1, said uncorrected bandgap voltage reference cell and said current supply circuit including resistors whose ratios determine the value of said correction voltage, independent of absolute resistance values.

3. A bandgap voltage reference circuit with output curvature correction, comprising:

(1) an uncorrected bandgap voltage reference cell that includes (a) first and second bipolar transistors having their bases connected together to provide a base output voltage, their collectors connected to receive respective collector currents, the emitter of the first cell transistor connected to a voltage reference through first and second series connected cell resistors, and the emitter of the second cell transistor connected to said voltage reference through the second but not the first cell resistor, said cell transistor being scaled in area to maintain a proportional to absolute temperature (PTAT) collector current for said second cell transistor, and (b) an output circuit connected to provide a final output voltage from said base output voltage that varies continuously with temperature over a predetermined temperature range, (2) an output voltage correction circuit comprising:

(a) a correction bipolar transistor having its base connected to the bases of said first and second cell transistors, its emitter connected through a first correction resistor to the junction of said first and second cell resistors, and its collector connected to receive a current through a second correction resistor, and (b) an operational amplifier having inverting and non-inverting inputs and an output connected respectively to the collector, base and emitter of said correction transistor, said amplifier establishing a substantially constant collector current for said correction transistor through said second correction resistor, said substantially constant current controlling the base-emitter voltage of said correction transistor to establish a correction current through said first correction and second cell resistors that modifies said base output voltage continuously over said predetermined temperature range to compensate for said final output voltage variation in accordance with $k_1T - k_2T\ln(k_3T)$, where $k_1$, $k_2$ and $k_3$ are constants and T is absolute temperature, the values of said resistors being selected to maintain a substantially constant base output voltage over said predetermined temperature range.

4. The circuit of claim 3, wherein in the absence of said output voltage correction circuit the uncorrected base output voltage has a temperature-dependent curvature component in the form $$\left[2\frac{R2}{R1}\ \frac{K}{q}\ln(A) - \frac{(E_g - V_{beref})}{T_{ref}}\right]T - (\sigma - 1)\frac{K}{q}T\ln\left(\frac{T}{T_{ref}}\right),$$

where R2 and R1 are the resistance values of the second and first cell resistors, K is Boltzmann's constant, q is the electron charge, in is the natural logarithm function, A is the ratio of the collector current densities of the second to the first cell transistors, $E_g$ is the bandgap voltage at 0° K., $V_{beref}$ is the base-emitter voltage of the first cell transistor at a reference temperature $T_{ref}$, T is the operating temperature in ° K. and $\sigma$ is the saturation current temperature exponent, and said output voltage correction circuit adds to said uncorrected base output voltage a temperature-dependent curvature correction in the form $$-\frac{K}{q}\ \frac{R2}{Rc1}\ln\left[\frac{R1}{Rc2}\ V_{Rc2}\right]T + \frac{K}{q}\ \frac{R2}{Rc1}T\ln\left[\frac{K}{q}T\ln(A)\right],$$

wherein Rc1 and Rc2 are the resistance values of the first and second correction resistors and $V_{Rc2}$ is the voltage across the second correction resistor, and the values of R1, R2, Rc1, Rc2, A and $V_{Rc2}$ are selected so that said output curvature correction substantially cancels the temperature curvature component of said uncorrected base output voltage.

5. The circuit of claim 3, wherein said operational amplifier comprises:

first and second bipolar amplifier transistors having their emitters connected together and their bases connected to receive said non-inverting and inverting inputs, respectively, third and fourth bipolar amplifier transistors having their emitters connected to a reference voltage, their bases respectively connected to the collectors of said first and second amplifier transistors, and their collectors respectively providing the operational amplifier output and connected to a current supply node, and an amplifier resistor connected between a voltage reference and the emitters of said first and second amplifier transistors.

6. The circuit of claim 5, wherein the resistance value of said amplifier resistor is selected to substantially equalize its current with the current through said second correction resistor, and to thereby substantially equalize the currents through said first and second amplifier transistors to inhibit voltage offsets at the amplifier's output.

7. A bandgap voltage reference circuit with output temperature curvature correction, comprising:

an uncorrected bandgap voltage reference cell that generates a voltage across a tail resistor, said voltage having a continuous temperature curvature component over a predetermined temperature range in the form $k_1T - k_2T\ln(k_3T)$, and that produces a base output voltage based upon said resistor voltage, where $k_1$, $k_2$ and $k_3$ are constants and T is absolute temperature, and an output voltage correction circuit that comprises:

a correction bipolar transistor having its base connected to said base output voltage, its emitter connected through a second correction resistor to provide a correction current to said tail resistor, and its collector connected to receive a current through a second correction resistor, and an operational amplifier having inverting and non-inverting inputs and an output connected respectively to the collector, base and emitter of said correction transistor, said amplifier producing a substantially constant current through said second correction resistor that establishes a correction current through said tail resistor, the resistance values of said resistors being selected so that said correction current produces a correction voltage across said tail resistor that various continuously with temperature over said predetermined temperature range and has the form $-k_1T + k_2T\ln(k_3T)$, thereby substantially cancelling the temperature curvature component of said uncorrected tail resistor voltage over said predetermined temperature range.

8. The circuit of claim 7, wherein said operational amplifier comprises:

first and second bipolar amplifier transistors having their emitters connected together and their bases connected to receive said non-inverting and inverting inputs, respectively, third and fourth bipolar amplifier transistors having their emitters connected to a voltage reference, their bases respectively connected to the collectors of said first and second amplifier transistors, and their collectors respectively providing the operational amplifier output and connected to a current supply node, and an amplifier resistor connected between a voltage reference and the emitters of said first and second amplifier transistors.

9. The circuit of claim 8, wherein the resistance value of said amplifier resistor is selected to substantially equalize the currents through said second correction age offsets at the amplifier's output.

10. A method of compensating for continuous temperature-induced variations in the output voltage from a bandgap voltage reference cell over a predetermined temperature range, said cell including a bipolar cell transistor with a proportional to absolute temperature (PTAT) collector current, comprising:

generating a collector current in a bipolar correction transistor that is substantially insensitive to temperature changes over said predetermined temperature range, obtaining the difference between the base-emitter voltage of said cell and correction transistors as a continuously varying function of temperature over said predetermined temperature range having the form $k_1T - k_2T\ln(k_3T)$, where $k_1$, $k_2$ and $k_3$ are constants and T is absolute temperature, combining said difference with said base output voltage, and selecting the values of $k_1$, $k_2$ and $k_3$ so that said base-emitter voltage difference substantially cancels said temperature-induced output voltage variations over said predetermined temperature range.

11. The method of claim 10, wherein said correction transistor's substantially temperature-insensitive collector current is generated by providing an operational amplifier with its inverting and non-inverting inputs and its output respectively connected to the collector, base and emitter of said correction transistor.

* * * * *